US008851608B2

(12) United States Patent
Wakui

(10) Patent No.: US 8,851,608 B2
(45) Date of Patent: Oct. 7, 2014

(54) IMAGE FORMING APPARATUS

(71) Applicant: FUJIFILM Corporation, Tokyo (JP)

(72) Inventor: Takashi Wakui, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/689,124

(22) Filed: Nov. 29, 2012

(65) Prior Publication Data

US 2013/0147871 A1 Jun. 13, 2013

(30) Foreign Application Priority Data

Dec. 8, 2011 (JP) ..... 2011-268745

(51) Int. Cl.

| | |
|---|---|
| ***B41J 29/38*** | (2006.01) |
| ***B41J 2/145*** | (2006.01) |
| ***B41J 2/21*** | (2006.01) |
| ***B41J 2/205*** | (2006.01) |
| ***B41J 2/005*** | (2006.01) |

(52) U.S. Cl.

CPC ..... *B41J 2/2121* (2013.01); *B41J 2/145* (2013.01); *B41J 2/205* (2013.01); *B41J 2/005* (2013.01); *B41J 2/21* (2013.01)

USPC ..... 347/14

(58) Field of Classification Search

CPC ..... B41J 29/38; B41J 2/2121; B41J 2/2135; B41J 2/36

USPC ..... 347/12, 14, 15, 19, 40–43

See application file for complete search history.

(56) References Cited

U.S. PATENT DOCUMENTS

| | | | | |
|---|---|---|---|---|
| 8,136,919 | B2 * | 3/2012 | Maru et al. | 347/40 |
| 2005/0219287 | A1 | 10/2005 | Tatsumi | |
| 2009/0315944 | A1 | 12/2009 | Maru et al. | |

FOREIGN PATENT DOCUMENTS

| | | | |
|---|---|---|---|
| JP | 2004-066468 | A | 3/2004 |
| JP | 2005-177990 | A | 7/2005 |
| JP | 2007-168201 | A | 7/2007 |

* cited by examiner

*Primary Examiner* — An Do

(74) *Attorney, Agent, or Firm* — Birch, Stewart, Kolasch & Birch, LLP

(57) ABSTRACT

At least two dot formers are provided for each of a plurality of colors. Dot formers, which form dots in a particular color, are disposed at a greater interval along a direction perpendicular to an array direction of dot forming elements than intervals along the direction perpendicular to the array direction at which other dot formers, which form dots in the remaining colors, are disposed.

12 Claims, 15 Drawing Sheets

IMAGE FORMING APPARATUS

CROSS-REFERENCE TO RELATED APPLICATION

This application is based upon and claims the benefit of priority from Japanese Patent Application No. 2011-268745 filed on Dec. 8, 2011, the contents of which are incorporated herein by reference.

BACKGROUND OF THE INVENTION

1. Field of the Invention

The present invention relates to an image forming apparatus having a plurality of dot forming elements arranged along an array direction for ejecting droplets therefrom to form dots, which have the same colors as the droplets, on a recording medium.

2. Description of the Related Art

With significant advances in inkjet technology in recent years, it is becoming possible for inkjet printers to produce large color prints of high quality at high speeds. Inkjet printers are widely used particularly in sign and display applications, and are applicable to the printing of POP (Point Of Purchase) posters, wall posters, outdoor advertisements, and billboards, etc., for example. Inkjet printers are capable of producing prints by ejecting droplets of a plurality of ink types, e.g., inks in C (cyan), M (magenta), Y (yellow), and K (black), onto a recording medium to form a number of dots thereon. Various inkjet printers have been proposed to form high-quality images using a plurality of recording heads, i.e., dot forming units, which are capable of ejecting ink droplets in the same colors.

For example, Japanese Laid-Open Patent Publication No. 2004-066468 discloses a recording head having chips as constituent elements thereof, in which color coordinates in a uniform color space are arranged in a sequence closer to the origin of the uniform color space, and axisymmetrically outward from a central line along a direction in which the chips are arranged. More specifically, the recording head is applied to a multipass inkjet printer in which the recording head is reciprocally moved transversely across a recording medium to scan the recording medium to form an image thereon. The recording head is effective to visually minimize image degradations that are caused by ink droplet landing errors.

SUMMARY OF THE INVENTION

Attention has been directed to various types of inkjet printers and single-pass inkjet printers, which incorporate a recording head (hereinafter referred to as a "line head") having a plurality of nozzles that are arranged along an array direction (hereinafter also referred to as a "main direction"). Single-pass inkjet printers can complete an image on a recording medium by moving the recording medium or the line head only once in a predetermined direction. Single-pass inkjet printers meet all of the various specifications required in sign and display applications, such as high-speed operation, low electric power consumption, and high image quality.

However, even if the recording head disclosed in Japanese Laid-Open Patent Publication No. 2004-066468 is incorporated in a single-pass inkjet printer, the combination fails to visually minimize image degradations caused by ink droplet landing errors. In addition, image degradations may also be brought about due to interference between ink droplets that have landed previously on the recording medium from one line head and ink droplets that land subsequently on the recording medium from another line head.

An object of the present invention is to provide an image forming apparatus, which is capable of appropriately controlling microscopic densities of an image formed on a recording medium, while taking into account the occurrence of landed ink droplet interference.

According to the present invention, there is provided an image forming apparatus comprising at least two dot formers each including a plurality of dot forming elements arranged along an array direction for ejecting droplets to form dots in one color on a recording medium.

The image forming apparatus also includes a dot formation controller for independently controlling the at least two dot formers to form the dots successively at a plurality of times to generate image arrays while the at least two dot formers and the recording medium are moved relatively to each other. The at least two dot formers and the recording medium are moved relatively to each other in a direction perpendicular to the array direction. At least two dot formers are provided for each of a plurality of colors. The at least two dot formers, which form the dots in a particular one of the plurality of colors, are disposed at a greater interval along the direction perpendicular to the array direction than the intervals along the direction perpendicular to the array direction at which the at least two dot formers, which form the dots in the remaining ones of the plurality of colors, are disposed.

As described above, at least two dot formers are provided for each of a plurality of colors, and the at least two dot formers, which form the dots in a particular one of the plurality of colors, are disposed at a greater interval along the direction perpendicular to the array direction than the intervals along the direction perpendicular to the array direction at which the at least two dot formers, which form the dots in the remaining ones of the plurality of colors, are disposed. Consequently, the difference between times at which droplets land on the recording medium to form the dots in the particular color is large enough to reduce interference between the landed droplets that form the dots in the particular color, compared with the dots in the remaining colors. Accordingly, microscopic density of an image formed on the recording medium can appropriately be controlled while taking into account interference between the landed droplets.

Preferably, the interval along the direction perpendicular to the array direction is determined based on visibility of the colors of the dots. The particular one of the plurality of colors comprises a color the visibility of which is highest among the plurality of colors. Therefore, microscopic density of an image on the recording medium can appropriately be controlled while taking into account the effect that interference between landed droplets has on the image. In particular, the adverse effect of interference between landed droplets can be minimized by relatively increasing the layout interval for the particular color the visibility of which is highest.

Preferably, the visibility is quantified based on granularity taking into account human visual response characteristics.

Preferably, the visibility is quantified based on a color difference between a color of the recording medium and colors of the dots formed on the recording medium.

Preferably, the interval along the direction perpendicular to the array direction becomes greater as the visibility is higher.

Preferably, the interval along the direction perpendicular to the array direction is determined based on unity of the colors of the dots, and the particular one of the plurality of colors comprises a color the unity of which is highest among the plurality of colors.

Preferably, the unity is quantified based on measurement of an image, which is produced by forming at least the dots in one color on the recording medium.

Preferably, the unity is quantified based on changes in positions where the dots are formed, caused by interference between the dots in one color that are adjacent on the recording medium.

Preferably, the unity is quantified based on degrees of deformation of the dots, caused by interference between the dots in one color that are adjacent on the recording medium.

Preferably, the unity is quantified based on changes in the image quality of the image, caused by interference between the dots in one color that are adjacent on the recording medium.

Preferably, the image quality is quantified based on an evaluation value, which is representative of at least one of granularity, sharpness, mottled appearance, striped irregularity, banding, gradation, and average density of the image.

Preferably, the interval along the direction perpendicular to the array direction becomes greater as the unity is higher.

As described above, with the image forming apparatus according to the present invention, at least two dot formers are provided for each of a plurality of colors, and the at least two dot formers, which form dots in a particular one of the plurality of colors, are disposed at a greater interval along a direction perpendicular to the array direction than intervals along the direction perpendicular to the array direction at which the at least two dot formers, which form the dots in the remaining ones of the plurality of colors, are disposed. Consequently, the difference between times when droplets land on the sheet that form the dots in the particular color is large enough to reduce interference between the landed droplets that form the dots in the particular color, compared with the dots in the remaining colors. Accordingly, microscopic density of an image formed on the recording medium can appropriately be controlled while taking into account interference between the landed droplets.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

An image forming apparatus according to a preferred embodiment of the present invention will be described below with reference to the accompanying drawings. In the following description, formation of an image will also be referred to as "printing".

[Arrangement of Image Forming Apparatus 10]

Figure 1:
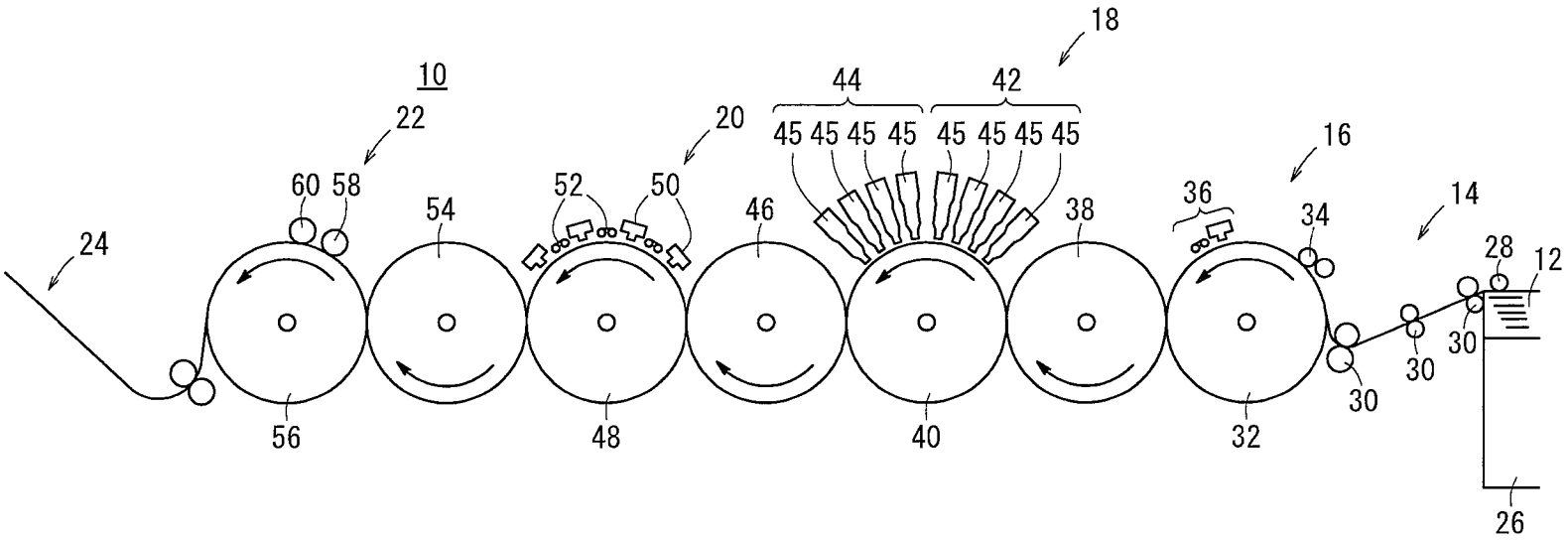
FIG. 1 is a sectional side elevational view of an image forming apparatus according to an embodiment of the present invention.

As shown in FIG. 1, an image forming apparatus 10 according to an embodiment of the present invention has a sheet delivery system including a sheet feeding assembly 14 for feeding sheets 12 as recording mediums. The sheet feeding assembly 14 is positioned at an upstream end of the sheet delivery system with respect to a direction (sheet feeding direction) at which the sheets 12 are fed through the image forming apparatus 10. The image forming apparatus 10 also includes, in the sheet delivery system, a processing solution coater 16 for coating the recording surface (hereinafter referred to as an "image forming surface") of each sheet 12 with a processing solution, an image former 18 for applying inks or coloring materials to the processing solution layer on the image forming surface, an ink drier 20 for drying inks contained in the processing solution layer on the sheet 12, an image fixer 22 for fixing an image in the processing solution layer on the sheet 12, and a sheet discharger 24 for discharging the sheet 12 with the fixed image. The processing solution coater 16, the image former 18, the ink drier 20, the image fixer 22, and the sheet discharger 24 are arranged successively along the sheet feeding direction downstream of the sheet feeding assembly 14.

The sheet feeding assembly 14 has a sheet stacker 26 for stacking sheets 12, a sheet supplier 28 for supplying one sheet 12 at a time from the sheet stacker 26, and a sheet feeder 30 for feeding the sheet 12 supplied by the sheet supplier 28 to the processing solution coater 16.

The processing solution coater 16 has a rotatable processing solution coating drum 32, a processing solution coating device 34 for coating the image forming surface of the sheet 12 with the processing solution, and a processing solution drying device 36 for drying the applied processing solution. The processing solution coater 16 applies a coating solution layer in the form of a thin film to the image forming surface of the sheet 12.

A first intermediate feed drum 38 is rotatably disposed between the processing solution coater 16 and the image former 18. The first intermediate feed drum 38 is rotated about its axis with the sheet 12 held on the circumferential surface thereof, thereby feeding the sheet 12 supplied from the processing solution coater 16 to the image former 18.

The image former 18 has a rotatable image forming drum 40 (feeder) and two head units 42, 44 for ejecting ink droplets onto the sheet 12 that is fed by the image forming drum 40. Each of the head units 42, 44 includes four line heads 45 (dot formers) in at least basic colors, i.e., Y, M, C, and K. Stated otherwise, two line heads 45 are available for each of different colors C, M, Y, and K.

The line heads 45 are arranged along the circumferential directions of the image forming drum 40. The line heads 45, which are arranged successively, form images in respective colors on the processing solution layer applied to the image forming surface of the sheet 12. The processing solution is effective to coagulate color materials (pigments) and latex particles, which are dispersed in solvents of the inks. Therefore, the processing solution can prevent the color materials from flowing on the sheet 12.

A second intermediate feed drum 46 is rotatably disposed between the image former 18 and the ink drier 20. The second intermediate feed drum 46 is rotated about its axis with the sheet 12 held on the circumferential surface thereof, thereby feeding the sheet 12 supplied from the image former 18 to the ink drier 20.

The ink drier 20 has a rotatable ink drying drum 48, a plurality of hot air nozzles 50 for drying the processing solution layer on the sheet 12, and a plurality of infrared heaters 52. The ink drier 20 dries off the solvent from the inks that remain in the processing solution layer on the sheet 12.

A third intermediate feed drum 54 is rotatably disposed between the ink drier 20 and the image fixer 22. The third intermediate feed drum 54 is rotated about its axis with the sheet 12 held on the circumferential surface thereof, thereby feeding the sheet 12 supplied from the ink drier 20 to the image fixer 22.

The image fixer 22 has a rotatable image fixing drum 56, a heating roller 58 disposed closely to the circumferential surface of the image fixing drum 56, and a fixing roller 60 pressed against the circumferential surface of the image fixing drum 56. The image fixer 22 heats and presses latex particles, which are coagulated by the processing solution, thereby fixing the latex particles as an image on the sheet 12.

While the image fixing drum 56 continuously rotates about its axis, the sheet 12, with the image fixed to the image forming surface thereof by the above processes performed by the image forming apparatus 10, is fed into the discharger 24, which is positioned downstream of the image fixer 22.

Figure 2:
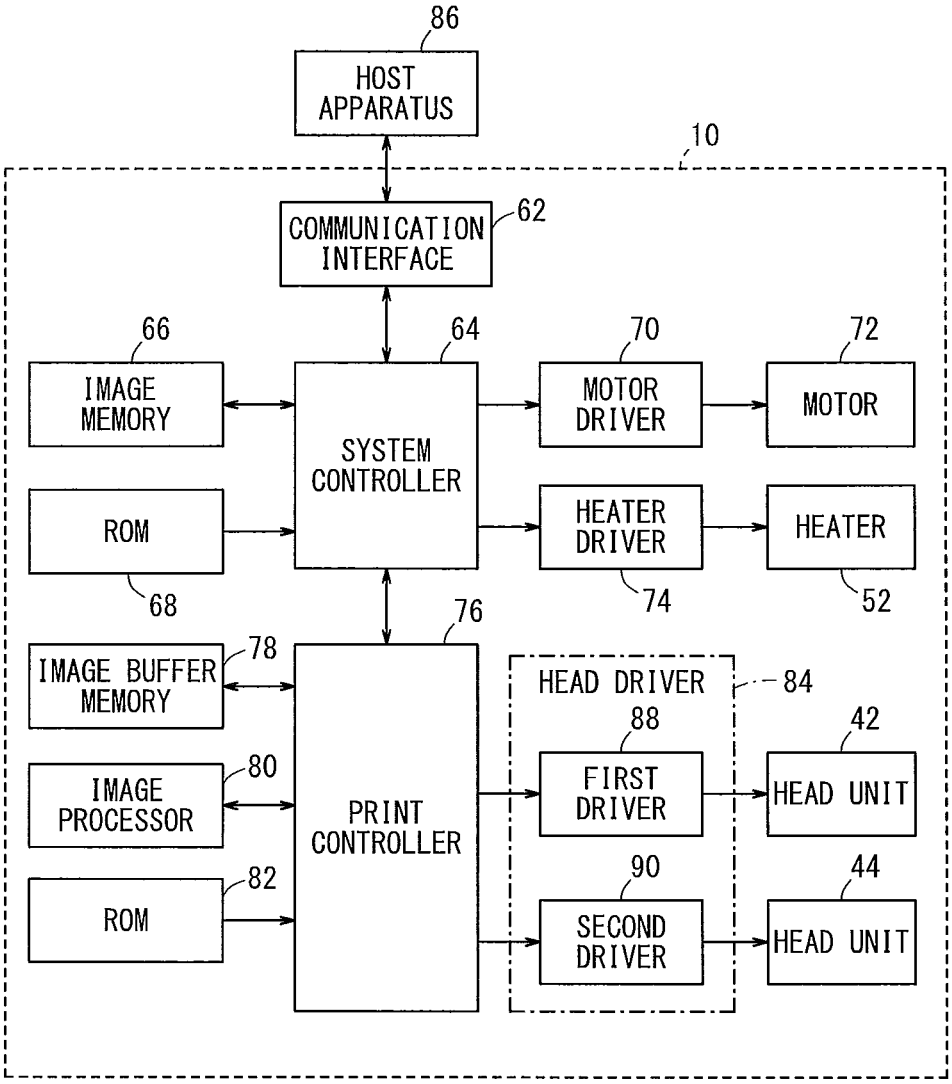
FIG. 2 is an electric block diagram showing a system arrangement of the image forming apparatus shown in FIG. 1.

FIG. 2 is an electric block diagram showing a system arrangement of the image forming apparatus 10 shown in FIG. 1. As shown in FIG. 2, the system arrangement of the image forming apparatus 10 includes, in addition to the two head units 42, 44 and the heaters 52 (see FIG. 1), a communication interface 62, a system controller 64, an image memory 66, a ROM 68, a motor driver 70, a motor 72, a heater driver 74, a print controller 76, an image buffer memory 78, an image processor (signal converter) 80, a ROM 82, and a head driver (dot formation controller) 84.

The communication interface 62 is an interface including a host apparatus 86, which is used by the user to enter into the image forming apparatus 10 instructions for forming an image. The communication interface 62 may comprise a serial interface such as a USB (Universal Serial Bus) terminal, an IEEE 1394 terminal, an Ethernet (registered trademark) terminal, a wireless network terminal, or the like, or a parallel interface such as a Centronics interface or the like. The communication interface 62 may incorporate a buffer memory, not shown, for achieving a higher communication rate.

An image signal supplied from the host apparatus 86 is read through the communication interface 62 into the image forming apparatus 10, and the image signal is temporarily stored in the image memory 66. The image memory 66 is a storage means for storing the image signal input through the communication interface 62. The image signal is read in and read out from the image memory 66 through the system controller 64. The image memory 66 may comprise a semiconductor memory, or alternatively, may comprise a magnetic medium such as a hard disk or the like.

The system controller 64, which comprises a central processing unit (CPU) and peripheral circuits, functions as a controller for controlling the image forming apparatus 10 in its entirety according to prescribed programs, and also functions as a processor for performing various processing operations. More specifically, the system controller 64 controls various components including the communication interface 62, the image memory 66, the motor driver 70, the heater driver 74, etc. The system controller 64 also controls communications with the host apparatus 86, and writing and reading of data into and out of the image memory 66 and the ROM 68. The system controller 64 generates control signals for controlling the motor 72 and the heaters 52 of the sheet delivery system. The system controller 64 sends control signals and also sends the image signal stored in the image memory 66 to the print controller 76.

The ROM 68 stores programs executed by the CPU of the system controller 64, and various data required to carry out various control processes. The image memory 66 is used as a storage area for temporarily storing image signals, and also is used as a storage area for storing programs and a working area for storing data processed by the CPU of the system controller 64.

The motor driver 70 is a drive circuit for energizing the motor 72 according to commands from the system controller 64. The heater driver 74 is a drive circuit for energizing the heaters 52 according to commands from the system controller 64.

The print controller 76, which comprises a CPU and peripheral circuits, is controlled by the system controller 64 cooperatively with the image processor 80 to perform various processing and correction processes to generate ink droplet ejection control signals from the image system stored in the image memory 66, and to supply the generated ink droplet ejection control signals, i.e., ink droplet ejection data, to the head driver 84 for controlling the head units 42, 44 to propel or eject ink droplets.

The print controller 76 is connected to the ROM 82, which stores programs executed by the CPU of the print controller 76, together with various data required to carry out various control processes. Although the ROM 82 may be a non-rewritable storage means, preferably, the ROM 82 is a rewritable storage means, such as an EEPROM or the like, if various data stored therein need to be updated as necessary. The image processor 80 generates dot layout data for different ink colors from an image signal input thereto (hereinafter referred to as an "input image signal"). More specifically, the image processor 80 performs a halftoning process on the input image signal to determine positions, i.e., ink ejection timings, at which dots are to be formed. The halftoning process may be an ordered dither method, an error diffusion method, a density pattern method, a random dot method, or the like. According to the present embodiment, an ordered dither method is used as the halftoning process.

In FIG. 2, the image processor 80 is shown as separate from the system controller 64 and the print controller 76. However, the image processor 80 may be included as part of the system controller 64 or the print controller 76.

The print controller 76 includes a drive waveform generating function, and an ink droplet ejection data generating function for generating ink droplet ejection data, i.e., control signals, for actuators corresponding to the nozzles of the line heads 45, based on dot layout data generated by the image processor 80.

Ink droplet ejection data that are generated by the ink droplet ejection data generating function are supplied to the head driver 84, which controls the head units 42, 44 to eject ink droplets. The drive waveform generating function is a function to generate drive signal waveforms for driving the actuators corresponding to the nozzles of the line heads 45. Signals, i.e., drive waveforms, generated by the drive waveform generating function are supplied to the head driver 84, which controls the amounts of ejected ink droplets in order to produce dots having substantially the same size or diameter, or to produce dots having a plurality of sizes or diameters.

The head driver 84 functions as a first driver 88, which is capable of independently controlling the line heads 45 of the head unit 42, and a second driver 90, which is capable of independently controlling the line heads 45 of the head unit 44. In other words, the head driver 84 is capable of independently controlling the head units 42, 44.

The print controller 76 is connected to the image buffer memory 78, which temporarily stores image data and other data, such as parameters that are used when the print controller 76 processes the image signal.

Figure 3:
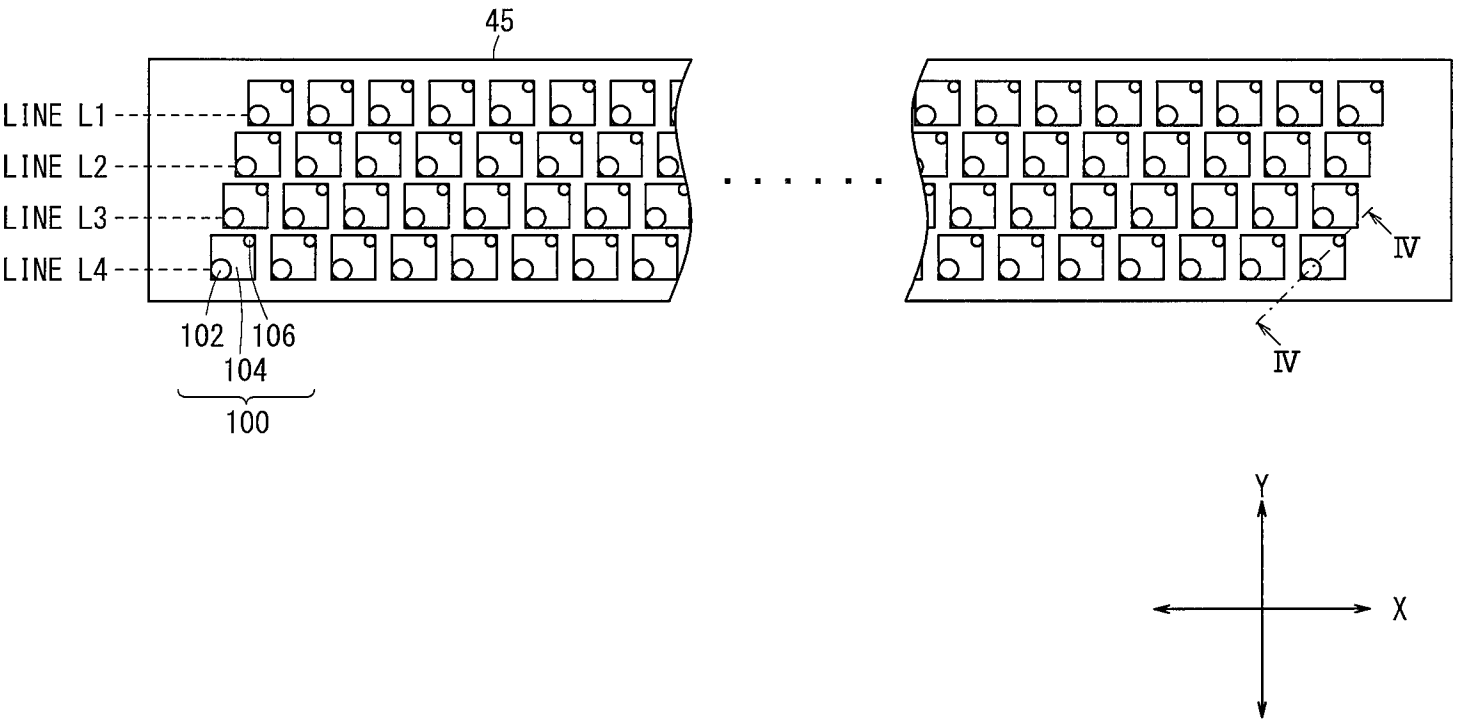
FIG. 3 is a fragmentary plan view showing an example of a configuration of a line head shown in FIG. 1.
Figure 4:
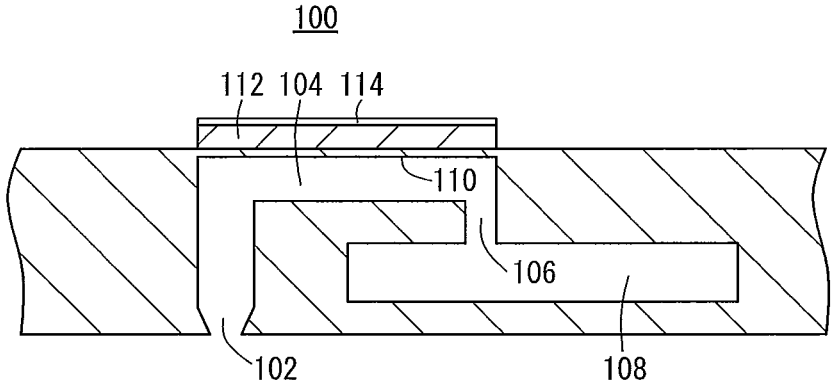
FIG. 4 is a cross-sectional view taken along line IV-IV of FIG. 3.

FIG. 3 is a fragmentary plan view showing a configuration example of each of the line heads 45 shown in FIG. 1. FIG. 4 is a cross-sectional view taken along line IV-IV of FIG. 3.

As shown in FIG. 3, the line head 45 has a plurality of ink chamber units 100 (dot forming elements) arranged in a staggered matrix. Each of the ink chamber units 100 comprises a nozzle 102, a pressure chamber 104, and a supply port 106. The pressure chamber 104, which has a substantially square planar shape, has an outlet defined in one of the diagonally opposite corners thereof and which is held in fluid communication with the nozzle 102, and an inlet defined in the other of the diagonally opposite corners thereof and which is held in fluid communication with the supply port 106 that is connected to a common channel 108 (see FIG. 4).

As shown in FIG. 4, the pressure chamber 104 is held in fluid communication with the common channel 108 through the supply port 106. The common channel 108 is held in fluid communication with an ink tank, not shown, which serves as an ink supply source. Ink supplied from the ink tank is distributed and supplied to the pressure chamber 104 through the common channel 108.

The pressure chamber 104 has an upper wall constructed as a pressurization plate 110 and which doubles as a common electrode. A piezoelectric element 112, which functions as an actuator for pressing and deforming the pressurization plate 110, is joined to an upper surface of the pressurization plate 110. An individual electrode 114 is disposed on the upper surface of the piezoelectric element 112.

In a case where a drive voltage is applied between the pressurization plate 110, which functions as a common electrode, and the individual electrode 114, the piezoelectric element 112, which is sandwiched between the two electrodes, is deformed, thereby changing the volume of the pressure chamber 104 and forcing the ink out of the nozzle 102 to discharge the ink as an ink droplet. After the ink droplet has been discharged, the drive voltage is removed, thereby allowing the piezoelectric element 112 to be restored to its original position, and refilling the pressure chamber 104 with ink from the common channel 108 through the supply port 106.

The layout of the nozzles 102 will be described below with reference to FIG. 3. The line head 45 shown in FIG. 3 has a longitudinal direction defined as an X direction, and a transverse direction defined as a Y direction. The sheet feeding direction is transverse (normal) to the X direction and parallel to the Y direction.

The nozzles 102 are arranged along a plurality of lines, including a line L1, a line L2, a line L3, and a line L4. The nozzles 102 along the line L1 are spaced at equal intervals, each corresponding to four unit lengths in the X direction. The nozzles 102 along the lines L2 through L4 are arranged in the same manner as the nozzles 102 along the line L1. The X direction will hereinafter also be referred to as an "array direction" of the nozzles 102, i.e., the ink chamber units 100.

The nozzles 102 along the line L2 are disposed in respective positions, which are shifted one unit length to the left from the corresponding nozzles 102 in the X direction along the line L1. The nozzles 102 along the line L3 are disposed in respective positions, which are shifted one unit length to the left from the corresponding nozzles 102 in the X direction along the line L2. The nozzles 102 along the line L4 are disposed in respective positions, which are shifted one unit length to the left from the corresponding nozzles 102 in the X direction along the line L3. The nozzles 102, which are projected onto a plane so as to lie in an array along the longitudinal direction of the line head 45, are virtually spaced very closely at reduced intervals, i.e., at reduced projected nozzle pitches.

The line head 45 may incorporate therein any of various ink droplet ejection mechanisms. The line head 45 may incorporate a piezoelectric mechanism, which as shown in FIGS. 3 and 4, includes actuators comprising piezoelectric elements. Alternatively, the line head 45 may incorporate a thermal jet mechanism, which includes heaters for heating the ink to produce air bubbles therein for ejecting ink droplets under the pressure of the air bubbles.

Figure 5:
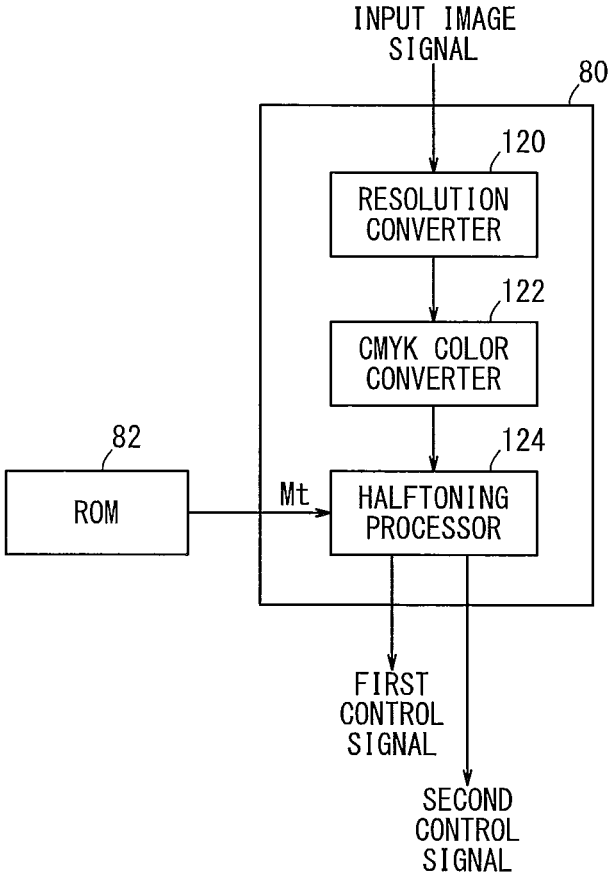
FIG. 5 is a functional block diagram showing an image processing sequence of an image processor shown in FIG. 2.

FIG. 5 is a functional block diagram that depicts an image processing sequence of the image processor 80 shown in FIG. 2. As shown in FIG. 5, the image processor 80 basically includes a resolution converter 120, a CMYK color converter 122, and a halftoning processor 124.

An image signal, which is input to the image processor 80, i.e., an input image signal, is a continuous-tone image signal having a plurality of color channels. The input image signal may comprise 8-bit RGB TIFF-format data representing 256 gradations per pixel.

According to an image scaling process for scaling up or down an image size, the resolution converter 120 converts the resolution of the input image signal into an output resolution depending on the image forming apparatus 10. The resolution converter 120 generates a first intermediate image signal representing the output resolution. The first intermediate image signal has the same data definition as the input image signal, but the data size thereof differs from that of the input image signal. The image scaling process may be based on any of various known algorithms including interpolation.

The CMYK color converter 122 converts the first intermediate image signal acquired from the resolution converter 120 into device color signals, i.e., C, M, Y, K color signals, which are handled by the image forming apparatus 10 according to a known color matching process. The CMYK color converter 122 generates a second intermediate image signal representing the device color signals. The second intermediate image signal corresponds to continuous-tone C, M, Y, K color signals.

The halftoning processor 124 converts the second intermediate image signal acquired from the CMYK color converter 122 into control signals for controlling the head units 42, 44 to eject ink droplets. The control signals are made up of binary data or multi-valued data for each of the colors C, M, Y, K for controlling the line head 45 (see FIGS. 1 and 3) to eject ink droplets, i.e., to turn on or off ink droplet ejection, in a time sequence. According to the present embodiment, the halftoning processor 124 performs an ordered dither method as the halftoning process using a threshold matrix Mt read from the ROM 82.

Figure 6:
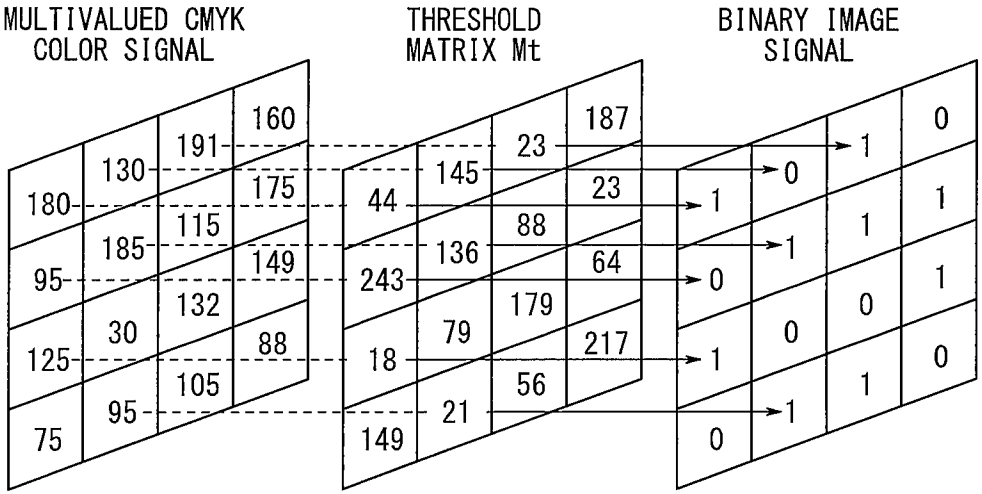
FIG. 6 is a diagram showing a half toning process (binarizing process) according to an ordered dither method.

FIG. 6 is a diagram showing a halftoning process (binarizing process) according to an ordered dither method. FIG. 6 shows the concept of a binarizing process based on a Bayer-pattern threshold matrix Mt. Addresses of multi-valued C, M, Y, K color signals are associated respectively with matrix elements of the threshold matrix Mt. The pixel value of a pixel in question is compared with the threshold value of a corresponding matrix element. If the pixel value is greater than the threshold value, then "1 (on)" is assigned to the image signal. Otherwise, "0 (off)" is assigned to the image signal. In this manner, gradations of the image signal are converted from a multi-value level into a binary level, thereby generating a binary image signal. If the threshold matrix Mt has threshold values for gradation levels other than binary gradation levels, then the halftoning processor 124 can generate multi-value image signals such as a tertiary image signal.

The control signals generated by the halftoning processor 124 include a first control signal that is supplied to the head unit 42, and a second control signal that is supplied to the head unit 44. Each of the control signals is sorted as a first control signal or a second control signal, depending on the memory address where the control signal is stored. For example, the first control signal is produced by extracting an odd-numbered line address in the X direction, whereas the second control signal is produced by extracting an even-numbered line address in the X direction.

Figure 7:
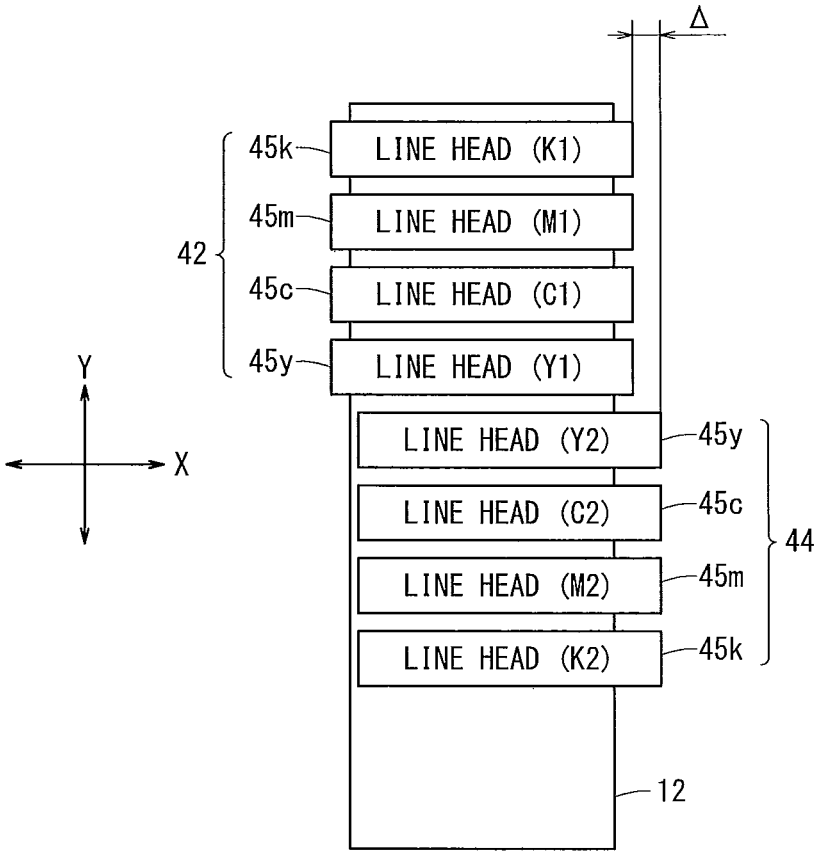
FIG. 7 is a schematic view showing a layout example of a plurality of line heads.

FIG. 7 is a schematic view showing an example layout of the line heads 45. In FIG. 7, and also in FIG. 8 to be described later, the line heads 45 are denoted by the reference numeral "45" together with suffixes "c", "k", "m", and "y" to indicate the types of line heads 45.

The head unit 42 includes a line head 45*k* in K, a line head 45*m* in M, a line head 45*c* in C, and a line head 45*y* in Y, which are successively arranged in this order from above. The head unit 44 includes a line head 45*y* in Y, a line head 45*c* in C, a line head 45*m* in M, and a line head 45*k* in K, which are successively arranged in this order from above. Stated otherwise, the corresponding two line heads 45 in the head units 42, 44 are spaced at greater intervals along the Y direction, i.e., the sheet feeding direction, in the order of K, M, C, and Y.

In FIG. 7, the line heads 45 in the head units 42, 44 are axisymmetrically arranged with respect to a central line between the head units 42, 44, in the order of Y, C, M, and K outwardly from the central line. Such a line head layout allows the head units 42, 44 to be fabricated as common parts, which is beneficial for production of the image forming apparatus 10. Alternatively, the order of the colors represented by the line heads may differ from head unit to head unit.

The head units 42, 44 are juxtaposed along the Y direction. The head unit 44, which is disposed downstream from the head unit 42 along the sheet feeding direction, is disposed at a position that is shifted to the right by a distance A from the head unit 42 along the X direction. The distance A is equivalent to two unit lengths, i.e., one half of the distance by which adjacent nozzles 102 shown in FIG. 3 are spaced from each other along the X direction.

Figure 8:
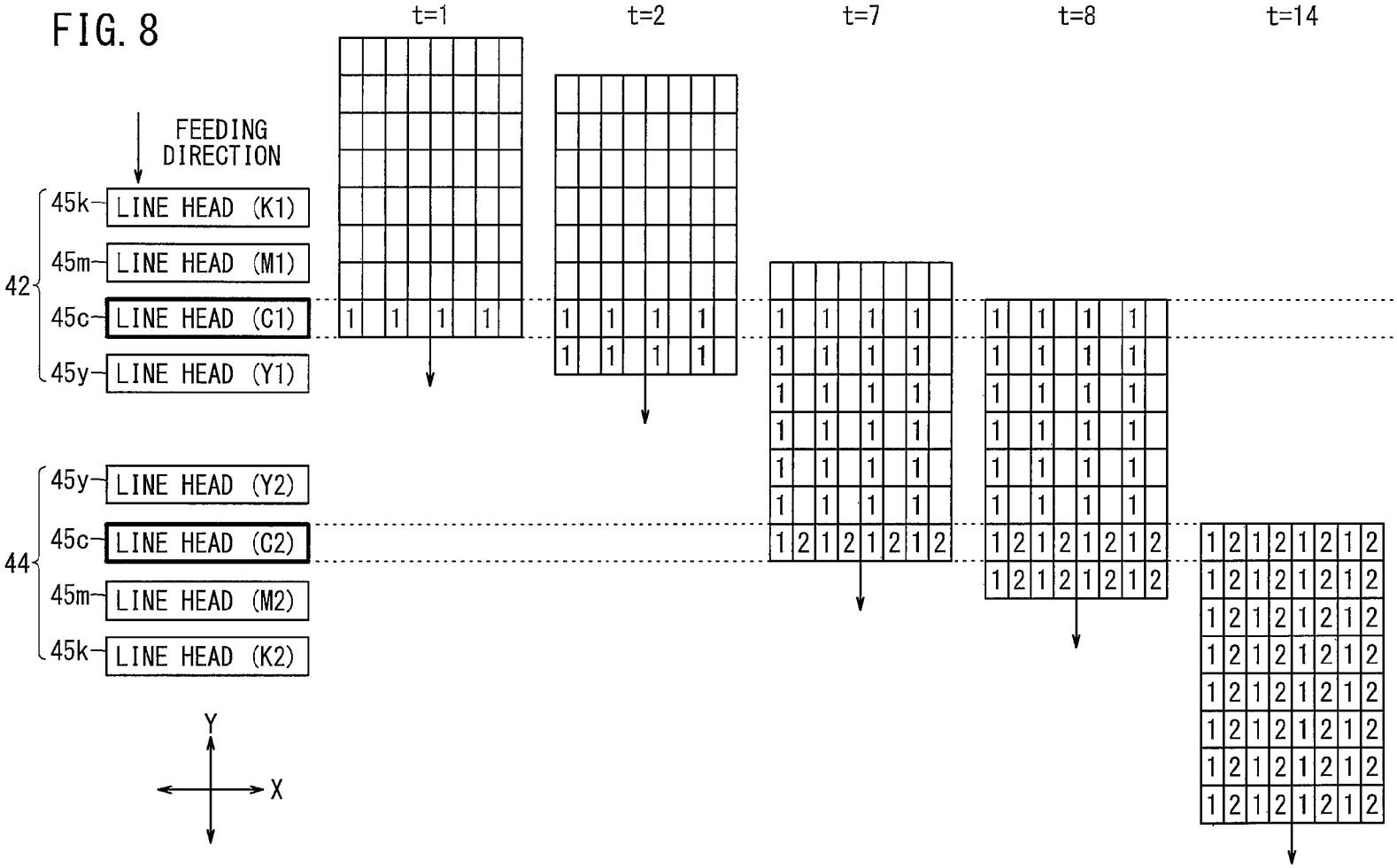
FIG. 8 is a diagram showing a sequence of ejecting ink droplets onto a sheet.

FIG. 8 is a diagram showing a sequence of ejecting ink droplets onto the sheet 12. For the sake of brevity, formation of an image using four nozzles 102 in one line, e.g., the line L4, from among the nozzles 102 (see FIG. 3) of the line head 45*c* in C of each of the head units 42, 44 will be described below.

FIG. 8 shows rectangular grids representative of images successively formed by the head units 42, 44. Each of the rectangular grids comprises a matrix of cells, each of which represents the area of a pixel of an image. Blank cells indicate image areas where ink droplets have not yet been ejected so as to land at each ejection time (t). Numerals in the cells indicate attributes of the head units 42, 44, which have ejected or caused ink droplets to land at corresponding image areas. More specifically, if the line head 45*c* of the head unit 42 is used to eject ink droplets to a cell, then the cell is indicated by "1", whereas if the line head 45*c* of the head unit 44 is used to eject ink droplets to a cell, then the cell is indicated by "2".

While the sheet 12 is fed at a constant speed upon rotation of the image forming drum 40 (see FIG. 1), ink droplets in C are ejected from the line heads 45*c* of the head units 42, 44 at given time intervals Δt (Δt=1 in FIG. 8), and the ink droplets in C land on the sheet 12. In this manner, a plurality of dots in cyan are successively formed on the sheet 12 along the sheet feeding direction.

At ejection times t=1 through 8, a plurality of dots are formed on the sheet 12 by the head unit 42, which is positioned upstream of the head unit 44 in the sheet feeding direction. At times t=7 through 14, a plurality of dots are formed on the sheet 12 by the head unit 44, which is positioned downstream of the head unit 42 in the sheet feeding direction. In this manner, by successively forming dots at a plurality of timings (two timings as shown in FIG. 8), image lines along the X direction are generated or completed.

The head units 42, 44 are positionally shifted from each other by the distance Δ, as described above. According to such a positional relationship between the head units 42, 44, gaps, which are formed along the X direction between the dots in one color that are produced by one line head 45*c* or 45*k* or 45*m* or 45*y*, are filled with dots in the same color that are produced by the other line head 45*c* or 45*k* or 45*m* or 45*y*. Consequently, resolution of the generated image is increased along the X direction.

The line heads 45 are not limited to a configuration having nozzles in lines L1 through L4, as shown in FIG. 3. Rather, each of the line heads 45 may be configured to have at least one line of nozzles arranged along the array direction, i.e., the X direction. Alternatively, short head elements may be joined along the array direction in order to make up a long line head 45. Further, alternatively, a plurality of head units 42, 44, i.e., three or more head units, which are capable of forming dots in one color, may be employed in the image former 18.

The ability of the image forming apparatus 10 having the head units 42, 44 to improve image quality of the image formed on the sheet 12 will be described below with reference to FIGS. 9A through 9C.

Figure 9A:
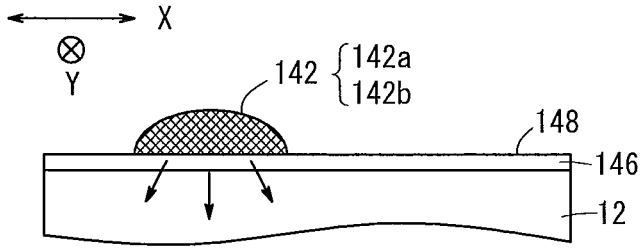
FIGS. 9A through 9C are views showing a time sequence of the formation of dots when a first droplet and a second droplet are ejected at different times.
Figure 9B:
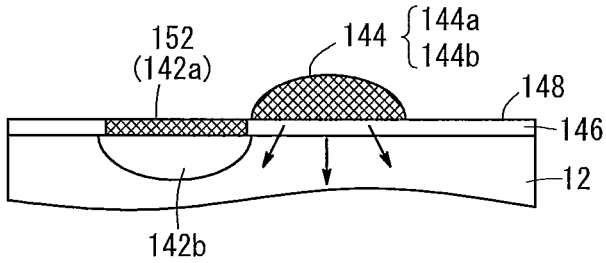
Figure 9C:
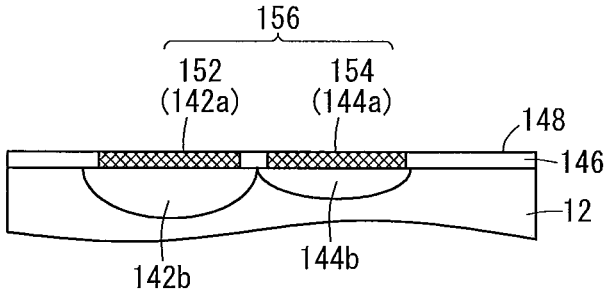

In FIGS. 9A through 9C, it is assumed that an ink droplet, which was ejected from the head unit 42 and has landed previously on the sheet 12, will hereinafter be referred to as a first droplet 142, and an ink droplet, which was ejected from the head unit 44 and has landed subsequently on the sheet 12, will hereinafter be referred to as a second droplet 144. For the sake of brevity, it also is assumed that the first droplet 142 contains a pigment 142*a* for coloring the sheet 12 as well as a solvent 142*b* in which the pigment 142*a* is dispersed. Similarly, the second droplet 144 contains a pigment 144*a* for coloring the sheet 12 as well as a solvent 144*b* in which the pigment 144*a* is dispersed. Before an image is formed on the sheet 12 by the image forming apparatus 10, the surface of the sheet 12 is coated with a processing solution by the processing solution coater 16. Hence, the sheet 12 has a processing solution layer 146 formed thereon.

FIGS. 9A through 9C are views showing a time sequence of formation of dots when the first droplet 142 and the second droplet 144 are ejected at different times. It is assumed that the first droplet 142 and the second droplet 144 are ejected and made to land in respective positions that are adjacent to each other in the X direction, i.e., the array direction.

Initially, the first droplet 142 lands on an image forming surface 148 of the processing solution layer 146 (see FIG. 9A). Thereafter, the first droplet 142 is absorbed into the sheet 12. The solvent 142*b* gradually diffuses into the processing solution layer 146 and the sheet 12. The pigment 142*a* chemically reacts with the processing solution, and coagulates together with the latex particles, not shown, to become trapped in the processing solution layer 146.

Upon elapse of a sufficient period of time after the first droplet 142 has landed, the second droplet 144 lands on the image forming surface 148 of the processing solution layer 146 (see FIG. 9B). At this time, the first droplet 142 no longer remains on the image forming surface 148, and has been fully absorbed into the sheet 12. In other words, the landed second droplet 144 does not interfere with the first droplet 142, but is absorbed into the sheet 12. The second droplet 144 is absorbed into the sheet 12 in the same manner as the first droplet 142.

Upon elapse of a sufficient period of time after the second droplet 144 has landed, a dot 152 based on the pigment 142*a* and a dot 154 based on the pigment 144*a* are formed on the processing solution layer 146. The dots 152, 154, which are grouped together along the X direction, will hereinafter be referred to as a dot cluster 156. Since the first droplet 142 and the second droplet 144 do not contact or interfere with each other on the image forming surface 148, the dot cluster 156 has a stable shape and produces a stable print color.

Two or more line heads 45 are provided for each of the colors C, M, Y, K. The distance along the Y direction between two or more of the line heads 45, which form dots 152, 154 in a certain color (K) of a plurality of colors (C, M, Y, K), is greater than the distance along the Y direction between two or more of the other line heads 45, which form dots 152, 154 in any of the other colors (C, M, Y). Since a large difference exists between the times at which the first droplet 142 and the second droplet 144 in the certain color (K) land, it is possible to make interference between landed ink droplets in the certain color (K) less liable to occur than interference between landed ink droplets in the other colors (C, M, Y). In other words, the microscopic density of an image on the sheet 12 can appropriately be controlled while taking into account interference between the landed ink droplets.

[Processes for Determining an Array of Line Heads 45]

Processes for determining an array of line heads 45 will be described below with reference to FIGS. 10A through 15. The determining processes include [1] a first process, which takes into account visibility of the colors of dots, and [2] a second process, which takes into account unity of dots in one color.

(Process of Calculating First Evaluation Values EV11, EV12, EV13)

According to the first process, an array of line heads 45 is determined based on first evaluation values EV11, EV12, and EV13, which are representative of a quantified visibility of the colors of dots. The first process will be described in specific detail below with reference to FIGS. 10A through 12.

First, a process of calculating the first evaluation value EV11 will be described below. The first evaluation value EV11 is an evaluation value for evaluating noise granularity (coarse texture).

Figure 10A:
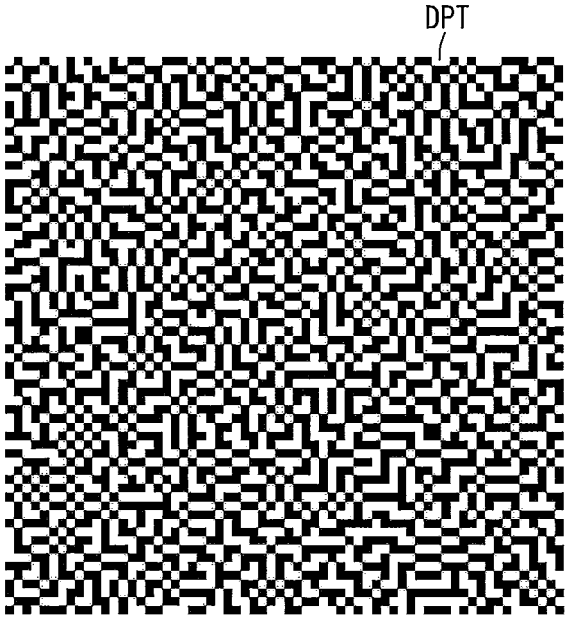
FIG. 10A is a diagram showing visual image data representing a dot pattern.

FIG. 10A is a diagram showing visual image data representing a dot pattern DPT. The dot pattern DPT shown in FIG. 10A corresponds to a 50% halftone image, which is actually generated by the halftoning processor 124 (see FIG. 5) using a square threshold matrix Mt each side of which is made up of 64 pixels.

Figure 10B:
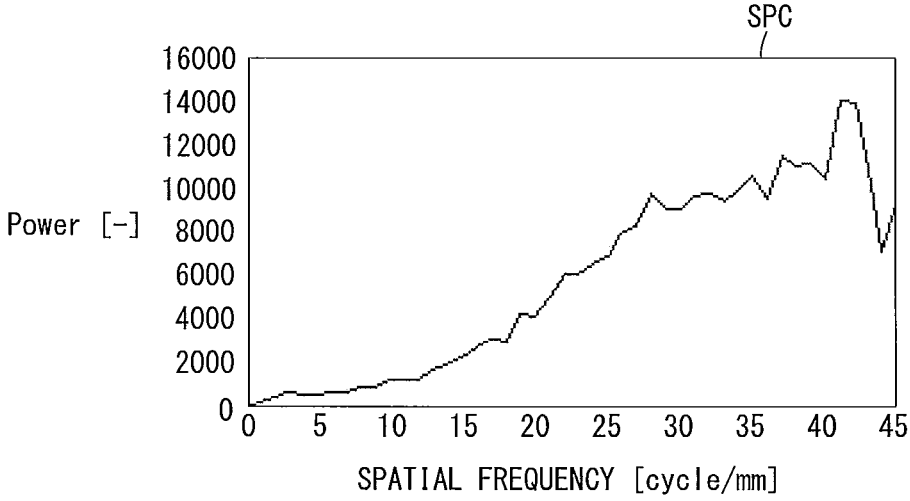
FIG. 10B is a diagram showing average values in a radial direction of a two-dimensional power spectrum, which is produced by performing a Fast Fourier Transform (FFT) on the image data shown in FIG. 10A.

FIG. 10B is a diagram showing average values in a radial direction of a two-dimensional power spectrum, which is produced by performing an FFT (Fast Fourier Transform) on the dot pattern DPT shown in FIG. 10A. An averaged power spectrum will hereinafter be referred to as a spectrum SPC. The spectrum SPC has a so-called high-pass (so-called blue-noise) spatial frequency characteristic, in which the intensity level is smaller in a low-to-middle spatial frequency range and greater in a high spatial frequency range.

According to an example of an evaluation technique for evaluating noise granularity, an RMS (Root Mean Square) of the dot pattern DPT may be determined. With a dot pattern DPT having a blue-noise spectrum SPC as shown in FIG. 10B, however, the RMS tends to increase even though the visibility thereof to an observer is good. In other words, there are instances in which RMS as an evaluation value and the result of sensory evaluation do not agree with each other. According to the present embodiment, the first evaluation value EV11 is used, which incorporates improved human visual response characteristics.

Figure 11:
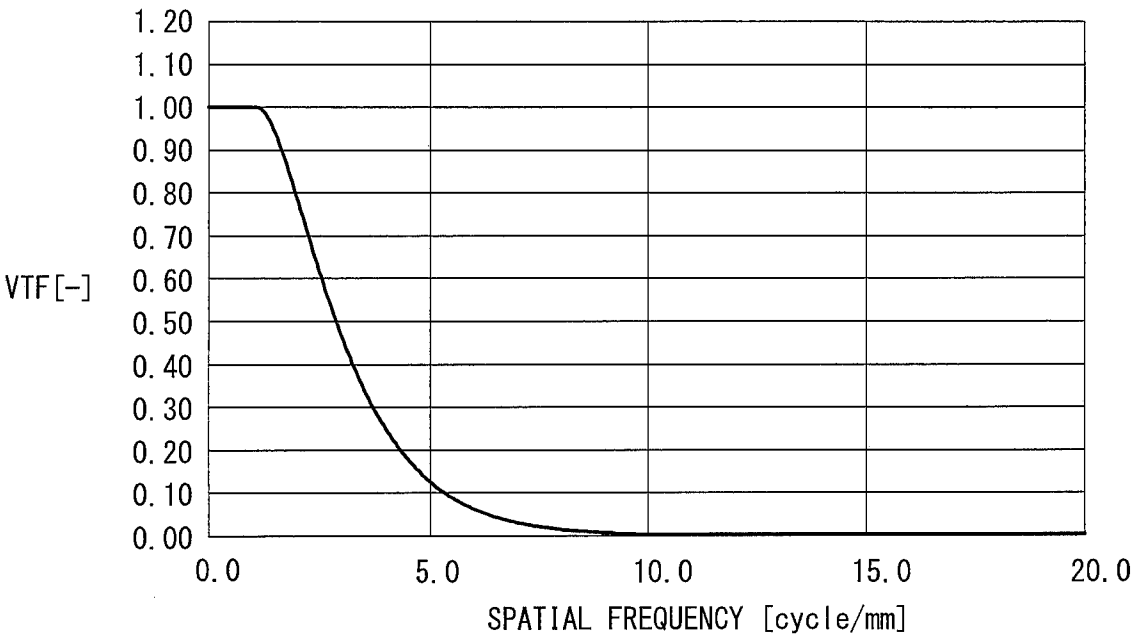
FIG. 11 is a graph showing a Dooley-Shaw function (observation distance: 300 mm)

FIG. 11 is a graph showing a Dooley-Shaw function (observation distance: 300 mm) as an example of standard human visual response characteristics.

According to the present embodiment, a Dooley-Shaw function (observation distance: 300 mm) is used to represent standard human visual response characteristics. The Dooley-Shaw function is a VTF (Visual Transfer Function), and is a typical function representing standard human visual response characteristics. More specifically, the Dooley-Shaw function corresponds to the square of a luminance-to-contrast ratio characteristic. The graph shown in FIG. 11 has a horizontal axis indicative of spatial frequencies (cycle/mm) and a vertical axis indicative of values of VTF (dimensionless).

Assuming the spectrum SPC has a value F(Ux, Uy), a first evaluation value EV11 is calculated according to the following equation (1).

$$EV11 = \left\{ \int_{-U_{max}}^{U_{max}} \int_{-U_{max}}^{U_{max}} VTF\left(\sqrt{Ux^2 + Uy^2}\right) F(Ux, Uy)\, dUx\, dUy \right\}^{\frac{1}{2}} \quad (1)$$

According to the Wiener-Khintchine theorem, a value produced by integrating the spectrum SPC with respect to the total spatial frequency band is in agreement with the square of the RMS. A value produced by multiplying the spectrum SPC by the VTF, and then integrating the new resultant spectrum SPC with respect to the total spatial frequency band serves as an evaluation index, which is in substantial agreement with human visual response characteristics. The first evaluation value EV11 is representative of granularity taking into account human visual response characteristics. Similar to the case with the normal RMS, the first evaluation value EV11 is a value of 0 or greater at all times, and becomes greater in value as the visibility of the color increases, i.e., as the color is made more visible, and becomes smaller in value as the visibility of the color decreases, i.e., as the color is made less visible.

A target image for calculating the first evaluation value EV11 may be the dot pattern DTP or a digital image, which is generated by reading an actually produced hard copy with a scanner device, not shown.

Alternatively, an inverse Fourier transform (e.g., IFFT) may be performed on the VTF shown in FIG. 11 in order to calculate a mask in an actual space corresponding to the VTF. Then, the mask is applied to image data to be evaluated in order to carry out a convolutional operation, and to determine the RMS with respect to the new image data. This process enables a result to be obtained, which is equivalent to the result of the above process using equation (1).

Processes for calculating first evaluation values EV12, EV13 will be described below. The first evaluation values EV12, EV13 are evaluation values for evaluating a color difference between a dot and a predetermined reference color. Assuming that the color of an evaluation target is represented by (L*, a*, b*) and the color of the sheet 12 is represented by (Lo*, ao*, bo*) in a CIELAB color space, the first evaluation value EV12 is calculated according to the following equation (2).

$$EV12=|L^*-Lo^*| \quad (2)$$

The first evaluation value EV12 corresponds to a lightness difference (ΔL*) between the color of the sheet 12 and the color of a dot formed on the sheet 12. The first evaluation value EV12 becomes greater in value as the visibility of the color increases, i.e., as the color is made more visible, and becomes smaller in value as the visibility of the color decreases, i.e., as the color is made less visible.

Figure 12:
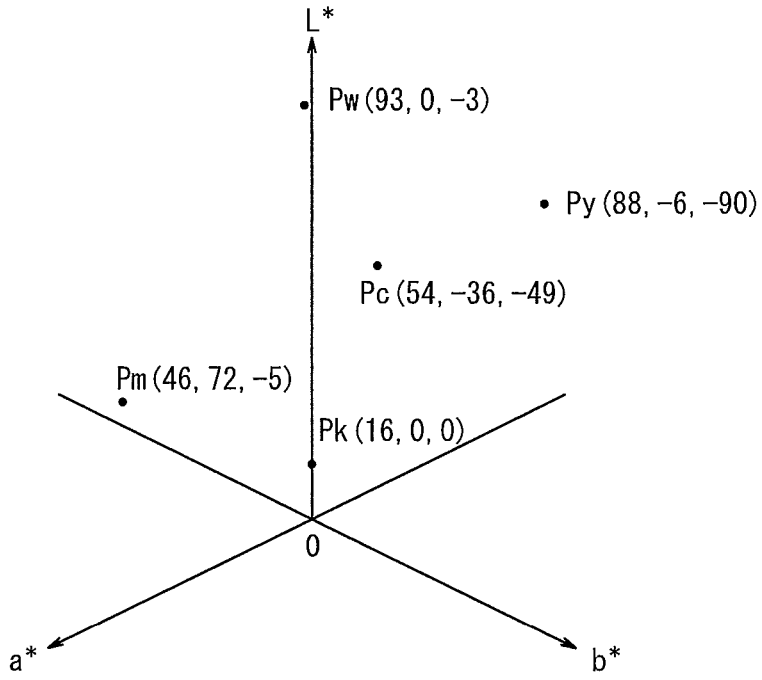
FIG. 12 is a diagram illustrative of a process of calculating a first evaluation value.

As shown in FIG. 12, it is assumed that the color (white point) of the sheet 12 (W) is represented by Pw(93, 0, −3), the color C is represented by Pc(54, −36, −49), the color M is represented by Pm(46, 72, −5), the color Y is represented by Py(88, −6, −90), and the color K is represented by Pk(16, 0, 0). The colors are arranged as K, M, C, Y colors according to a descending order of the first evaluation values EV12 thereof. In the example shown in FIG. 7, intervals at which the line heads 45 are disposed, i.e., the arrayed order of the line heads 45, are determined according to the above color order. Stated otherwise, the intervals at which the line heads 45 are disposed become greater as the visibility of the colors is higher.

From another standpoint, the first evaluation value EV13 is calculated according to the following equation (3).

$$EV13=\sqrt{(a^*-ao^*)^2+(b^*-bo^*)^2} \quad (3)$$

The first evaluation value EV13 corresponds to a chroma difference between the color of the sheet 12 and the color of a dot formed on the sheet 12. Contrary to the first evaluation value EV11, the first evaluation value EV12 becomes smaller in value as the visibility of the color increases, i.e., as the color is made more visible, and becomes greater in value as the visibility of the color decreases, i.e., as the color is made less visible. In the example shown in FIG. 12, the colors are arranged as K, M, C, Y colors according to an ascending order of the first evaluation values EV13 thereof. The line heads 45 may be arranged in a layout that differs from the example shown in FIG. 7. More specifically, the line heads 45*c* and the line heads 45*m* may be switched.

The color space in which the first evaluation values EV12, EV13 are calculated preferably is a device-independent color space, which is a color coordinate system that does not depend on device properties. In addition to CIELAB, a color coordinate system such as CIELUV, CIEXYZ, CIEHSV (Hue-Saturation-Value), CIEHLS (Hue-Lightness-Saturation), CEICAMO2, or the like may be used as such a device-independent color space.

In this manner, by determining layout intervals for the line heads 45 based on the first evaluation values EV11, EV12, EV13, which are representative of a quantified visibility of colors of the dots, the microscopic density of an image on the sheet 12 can be controlled appropriately while taking into account the effect that interference between landed ink droplets has on the image. In particular, the adverse effect of interference between landed ink droplets can be minimized by relatively increasing the layout interval for a particular color (K in the present embodiment) the visibility of which is highest.

(Processes for Calculating Second Evaluation Values EV21, EV22)

According to a second process, an array of line heads 45 is determined based on second evaluation values EV21, EV22, which are representative of a quantified unity of dots in one color. More specifically, the second evaluation values EV21, EV22 are values based on a measurement (microscopic measurement) of an image, which is formed by dots in at least one color. The second evaluation values EV21, EV22 will be described in specific detail below with reference to FIGS. 13A through 15B.

Figure 13A:
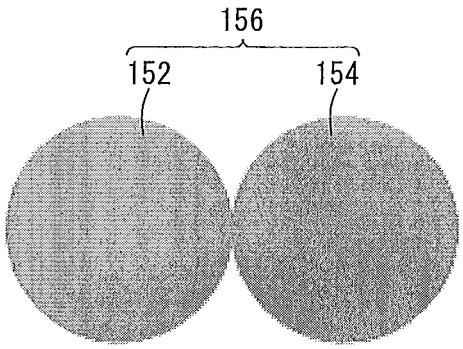
FIGS. 13A and 13B are diagrams showing shapes of dot clusters.

As described above with reference to FIGS. 9A through 9C, if the difference between times at which the first droplet 142 and the second droplet 144 land on the sheet 12 is sufficiently large, the dots 152, 154, which are substantially of the same diameter, are formed on the image forming surface 148 without interfering with each other. As a result, an ideal dot cluster 156 is formed as shown in FIG. 13A.

Figure 13B:
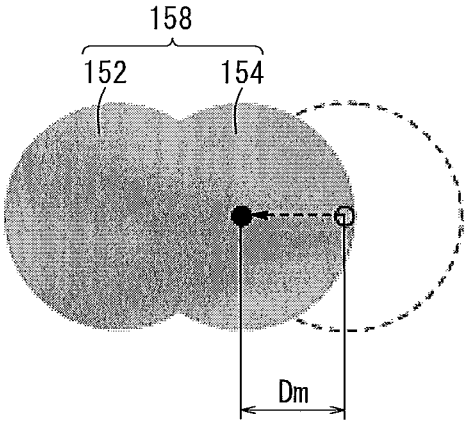

On the other hand, if the difference between times at which the first droplet 142 and the second droplet 144 land on the sheet 12 is small, then interference occurs between the landed ink droplets on the image forming surface 148. In this case, although a portion of the first droplet 142 has already been absorbed into the sheet 12, the remainder of the first droplet 142 still exists on the image forming surface 148. Therefore, the second droplet 144 unites with the remainder of the first droplet 142, and thereafter, the inks blend with each other due to their surface tension. As a consequence, as shown in FIG. 13B, the position, e.g., the center of gravity, where the dot 154 is formed by the second droplet 144 is shifted a certain distance toward the dot 152 formed by the first droplet 142. Unity of the adjacent dots 152, 154 in one color will be quantified below using the distance by which the position of the formed dot 154 has changed.

Figure 14:
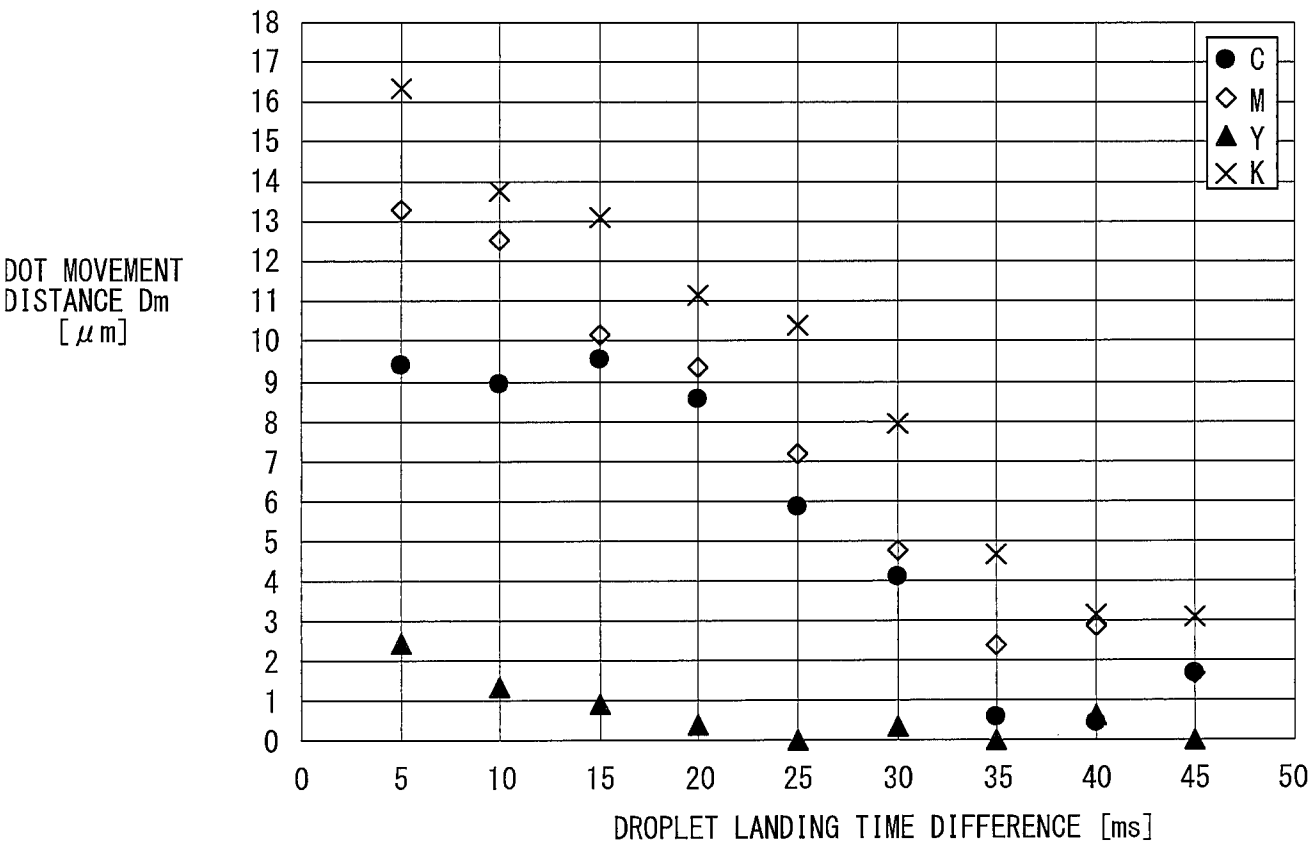
FIG. 14 is a graph showing the relationship between dot movement distances and droplet landing time differences.

FIG. 14 is a graph showing the relationship between dot movement distances Dm and droplet landing time differences. The graph has a horizontal axis representing intervals of time from landing of the first droplet 142 to landing of the second droplet 144, i.e., droplet landing time differences (unit: ms), and has a vertical axis representing distances by which the center of gravity of the dot 154 formed by the subsequently landed second droplet 144 is shifted, i.e., dot movement distances Dm (unit: μm).

As can be seen from FIG. 14, the dots formed in different colors exhibit a common tendency whereby, regardless of the color of the ink, the dot movement distance Dm becomes smaller as the droplet landing time difference decreases, and the dot movement distance Dm becomes greater as the droplet landing time difference increases. The dot movement distance Dm also becomes greater depending on the colors of the inks, i.e., in the order of K, M, C, and Y.

The second evaluation value EV21 may be determined from the characteristic curves shown in FIG. 14. For example, the dot movement distance Dm achieved if the droplet landing time difference is of a certain value, e.g., 20 ms, may be determined as the second evaluation value EV21. Alternatively, an approximate curve, e.g., a straight regression line, may be calculated from data in each of respective colors, and the absolute value of the gradient of the straight regression line may be determined as the second evaluation value EV21. The second evaluation value EV21 becomes greater in value as the unity of the dots increases, and becomes smaller in value as the unity of the dots decreases.

In the example shown in FIG. 7, the intervals at which the line heads 45 are disposed, i.e., the arrayed order of the line heads 45, are determined according to the above color order. Stated otherwise, the intervals at which the line heads 45 are disposed are increased as the unity of the dots in one color becomes higher.

A process for calculating the second evaluation value EV22 will be described below. More specifically, unity of adjacent dots 152, 154 in one color will be quantified below using the degree of deformation of the dot clusters 156, 158, or the dots 152, 154 that make up the dot clusters 156, 158.

Figure 15A:
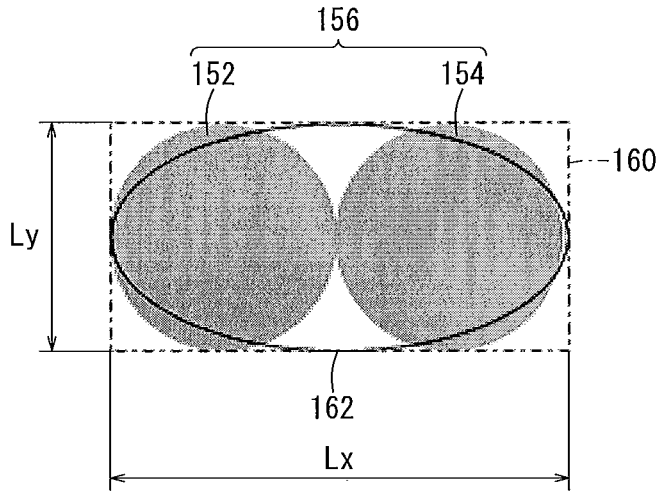
FIGS. 15A and 15B are diagrams illustrative of a process of calculating a second evaluation value.
Figure 15B:
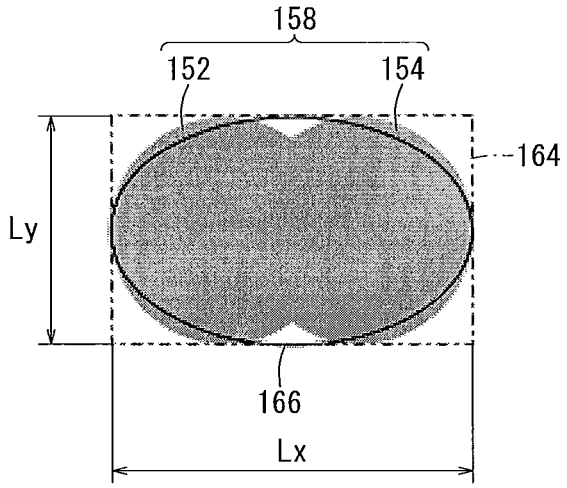

FIGS. 15A and 15B are diagrams illustrative of a process for calculating the second evaluation value EV22. FIG. 15A is a diagram showing another evaluation result concerning the dot cluster 156 shown in FIG. 13A, and FIG. 15B is a diagram showing another evaluation result concerning the dot cluster 158 shown in FIG. 13B.

As shown in FIG. 15A, if the dot cluster 156 is circumscribed by a rectangle 160 having a longer side parallel to the X direction, which is of a length Lx, and a shorter side parallel to the Y direction, which is of a length Ly, then the second evaluation value EV22 is calculated according to the following equation (4).

$$EV22 = \frac{Ly}{Lx} \tag{4}$$

The second evaluation value EV22 corresponds to the ellipticity, i.e., the aspect ratio, of an ellipse 162 inscribed in the rectangle 160. The dot cluster 156 shown in FIG. 13A is made up of adjacent dots 152, 154, which have circular shapes of substantially the same diameter. The second evaluation value EV22 of the dot cluster 156 shown in FIG. 13A is about 0.5. The dot cluster 158 shown in FIG. 13B is more circular than the dot cluster 156 shown in FIG. 13A as a result of surface tension acting between the first droplet 142 and the second droplet 144. The second evaluation value EV22 of the dot cluster 158 shown in FIG. 13B is about 0.6. The second evaluation value EV22 approaches 1 as the unity of the dots increases, and becomes closer to 0.5 as the unity of the dots decreases.

Intervals at which the line heads 45 are disposed are determined based on the second evaluation values EV21, EV22, which are representative of a quantified unity of dots in one color. In this manner, the microscopic density of an image on the sheet 12 can appropriately be controlled while taking into account interference between landed ink droplets. In particular, the occurrence of interference between landed ink droplets can be minimized by relatively increasing the layout interval for a particular color (K in the present embodiment) the dot unity of which is highest.

(Process of Calculating Third Evaluation Value EV3)

According to a third process, the array of line heads 45 is determined based on a third evaluation value EV3, which is representative of a quantified unity of dots in one color. More specifically, the third evaluation value EV3 is a value based on a measurement, i.e., a macroscopic measurement, of an image that is formed by dots of at least one color.

First, the user uses the image forming apparatus 10 to print a prescribed test pattern on the sheet 12. The test pattern represents an image in a uniform color or a fine-line image, and includes at least dots in a color to be estimated. Preferably, a test pattern is printed in only one color to be estimated, so as to avoid the occurrence of interference with landed ink droplets in other colors.

Then, the user evaluates the image quality of the printed test pattern. Items for evaluating image quality include at least one of granularity, sharpness, mottled appearance (spotted appearance), striped irregularity (shade differences due to landing errors of ink droplets), banding (shade differences caused by the feeding of the sheet 12), gradation, and average density (density uniformity) of the printed test pattern. An evaluation index may be any of various known physical indexes, or may be a general index representative of a combination of at least two of the aforementioned evaluation items. Alternatively, the evaluation index may be an index obtained from sensory evaluation, rather than physical indexes. The evaluation value indicative of the image quality thus evaluated is represented by Qorg.

Then, the user uses the image forming apparatus 10 in order to print a test pattern, which is of the same form as described above, on the sheet 12 under image forming conditions that cause little or no interference between landed ink droplets (hereinafter referred to as ideal conditions). Such ideal conditions differ from normal image forming conditions in that (a) the speed at which the sheet 12 is fed is lowered, (b) the used sheet 12 absorbs an increased amount of ink or absorbs ink at an increased rate, (c) the head units 42, 44 are spaced at an increased interval along the Y direction, or (d) the head units 42, 44 are controlled according to a modified process. An evaluation value indicative of the image quality thus evaluated is represented by Qideal.

Using the evaluation values Qorg, Qideal, the third evaluation value EV3 is calculated according to the following equation (5).

$$EV3 = |Qorg - Qdeal| \tag{5}$$

The third evaluation value EV3 corresponds to a change in image quality of a test pattern (image) caused by interference between adjacent dots in one color. The third evaluation value EV3, which is a value that is always 0 or greater, becomes greater as the change in image quality increases, i.e., the unity of dots in one color is higher, and becomes smaller as the change in image quality is smaller, i.e., the unity of dots in one color is lower. Equation (5) may be any equation representative of a change in image quality, and may be replaced with another equation that involves division, for example, rather than subtraction. Some of the image forming conditions, e.g., the speed at which the sheet 12 is fed and the rate at which the sheet 12 absorbs inks, may be changed. The evaluation value Qorg may be calculated with respect to such changed speeds and rates, and the third evaluation value EV3 may be calculated based on the obtained changes in image quality.

Layout intervals of the line heads 45 are determined based on the third evaluation value EV3, which is representative of the quantified unity of dots in one color. The microscopic density of an image which is formed on the sheet 12 can be controlled appropriately while taking into account interference between landed ink droplets.

The present invention is not limited to the above embodiment. Various changes and modifications may be made to the embodiment without departing from the scope of the invention.

While four colors C, M, Y, and K have mainly been described in the above embodiment, the present invention may be carried out using any type or number of colors. For example, standard inks in C, M, Y, and K and optional inks in pale colors such as LC (light cyan), LM (light magenta), and W (white) may be combined with each other.

In the above embodiment, only the sheet 12 is fed by rotation of the image forming drum 40. However, at least one of the head units 42, 44 and the sheet 12 may be fed, since the present invention remains applicable so long as the head units 42, 44 and the sheet 12 are moved relatively to each other.

In the above embodiment, the image forming apparatus 10 includes the same numbers of line heads 45, i.e., two sets of line heads 45, for all colors C, M, Y, and K. However, the number of line heads 45 may be different depending on the colors. For example, the image forming apparatus 10 may have one line head 45 for one color and three or more line heads 45 for another color.

What is claimed is:

1. A single-pass inkjet image forming apparatus in which dot formers move in only one direction, comprising:

at least two of said dot formers each including a plurality of dot forming elements arranged along an array direction for ejecting droplets to form dots in one color on a recording medium; and a dot formation controller for independently controlling the at least two dot formers to form the dots successively at a plurality of times to generate image arrays while the at least two dot formers and the recording medium are moved relatively to each other, wherein:

the at least two dot formers and the recording medium are moved relatively to each other in a direction perpendicular to the array direction;

the at least two dot formers are provided for each of a plurality of colors; and the at least two dot formers, which form the dots in a particular one of the plurality of colors, are disposed at a greater interval along the direction perpendicular to the array direction than the intervals along the direction perpendicular to the array direction at which the at least two dot formers, which form the dots in the remaining ones of the plurality of colors, are disposed.

2. The image forming apparatus according to claim 1, wherein the interval along the direction perpendicular to the array direction is determined based on visibility of the colors of the dots; and the particular one of the plurality of colors comprises a color the visibility of which is highest among the plurality of colors.

3. The image forming apparatus according to claim 2, wherein the visibility is quantified based on granularity taking into account human visual response characteristics.

4. The image forming apparatus according to claim 2, wherein the visibility is quantified based on a color difference between a color of the recording medium and colors of the dots formed on the recording medium.

5. The image forming apparatus according to claim 2, wherein the interval along the direction perpendicular to the array direction becomes greater as the visibility is higher.

6. The image forming apparatus according to claim 1, wherein the interval along the direction perpendicular to the array direction is determined based on unity of the colors of the dots; and the particular one of the plurality of colors comprises a color the unity of which is highest among the plurality of colors.

7. The image forming apparatus according to claim 6, wherein the unity is quantified based on measurement of an image, which is produced by forming at least the dots in one color on the recording medium.

8. The image forming apparatus according to claim 7, wherein the unity is quantified based on changes in positions where the dots are formed, caused by interference between the dots in one color that are adjacent on the recording medium.

9. The image forming apparatus according to claim 7, wherein the unity is quantified based on degrees of deformation of the dots, caused by interference between the dots in one color that are adjacent on the recording medium.

10. The image forming apparatus according to claim 7, wherein the unity is quantified based on changes in the image quality of the image, caused by interference between the dots in one color that are adjacent on the recording medium.

11. The image forming apparatus according to claim 10, wherein the image quality is quantified based on an evaluation value, which is representative of at least one of granularity, sharpness, mottled appearance, striped irregularity, banding, gradation, and average density of the image.

12. The image forming apparatus according to claim 6, wherein the interval along the direction perpendicular to the array direction becomes greater as the unity is higher.

* * * * *